US005202528A

United States Patent [19]

Iwaooji

[11] Patent Number: 5,202,528

[45] Date of Patent: Apr. 13, 1993

[54] ELECTRONIC MUSICAL INSTRUMENT WITH A NOTE DETECTOR CAPABLE OF DETECTING A PLURALITY OF NOTES SOUNDED SIMULTANEOUSLY

[75] Inventor: Makoto Iwaooji, Hamuramachi, Japan

[73] Assignee: Casio Computer Co., Ltd., Tokyo, Japan

[21] Appl. No.: 683,339

[22] Filed: Apr. 10, 1991

[30] Foreign Application Priority Data

May 14, 1990 [JP] Japan ..... 2-123789

[51] Int. Cl.[5] ..... G10H 7/00

[52] U.S. Cl. ..... 84/616; 84/617; 84/654; 84/655; 84/661; 84/DIG. 9

[58] Field of Search ..... 84/600, 603, 615-617, 84/645, 647, 653, 654, 661, 681, 700, 736, DIG. 9, 453, 454, DIG. 18, 655, 682; 381/83, 93; 324/77 C, 78 F, 78 D

[56] References Cited

U.S. PATENT DOCUMENTS

| | | | |
|---|---|---|---|
| 4,014,237 | 3/1977 | Milde, Jr. | 84/453 X |
| 4,041,783 | 8/1977 | Shimauchi et al. | 84/454 X |
| 4,354,248 | 10/1982 | Conger et al. . | |
| 4,389,538 | 6/1983 | White | 324/77 C X |
| 4,399,732 | 8/1983 | Rothschild et al. | 84/454 |
| 4,732,071 | 3/1988 | Deutsch | 84/454 |
| 4,866,260 | 9/1989 | Lescourret | 324/78 F X |
| 5,024,134 | 6/1991 | Uchiyama | 84/654 |
| 5,048,391 | 9/1991 | Uchiyama et al. | 84/654 |

FOREIGN PATENT DOCUMENTS

| | | |
|---|---|---|
| 57-692 | 1/1982 | Japan . |
| 58-97179 | 6/1983 | Japan . |
| 60-26091 | 2/1985 | Japan . |

OTHER PUBLICATIONS

IPSJ National Convention Record 1988 the letter term pp. 1962-1963.

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

A voice input to a microphone is converted by an A/D converter to a digital signal which is then delivered to a DSP, which extracts the notes of the input voice for determining same. The processing by the DSP includes bandpass filtering with a frequency corresponding to each note as the central frequency. A plurality of notes is processed on a time divisional basis to determine their respective notes. A new musical sound electronically corresponding to one or more notes extracted as the result of the note detection is then generated on a real time basis.

6 Claims, 12 Drawing Sheets

ELECTRONIC MUSICAL INSTRUMENT WITH A NOTE DETECTOR CAPABLE OF DETECTING A PLURALITY OF NOTES SOUNDED SIMULTANEOUSLY

BACKGROUND OF THE INVENTION

1. Field of the Invention

The present invention generally relates to notes detector which receives an input of a musical instrument sound or a human voice, extracts its pitch, determines its note and generates a musical sound electronically in accordance with the result of the determination. More particularly, the present invention relates to a note detector which receives a plurality of musical instrument sounds and/or human voices, including a chord to perform note detecting operations and to an electronic instrument with such a note detector.

2. Description of the Related Art

Conventionally, techniques are provided of receiving an input of a musical instrumental sound or a human voice, extracting its pitch, determining its note, and printing out the result in the form of a score, or encoding and recording the series of results of determination in order to execute an automatic performance by generating other musical instrument sounds (for example, as disclosed in Published Unexamined Japanese Patent Applications Sho 57-692 and Sho 58-97179).

Actually, such prior arts can only handle an input of a single sound basically and does not allow for an input of a plurality of sounds including a chord.

It was proposed that the name of a chord is detected in response to reception of an input of the chord and displayed in accordance with a signal indicative of the name of the chord (Published Unexamined Japanese Utility Model Application Sho 60-26091).

This application discloses provision of analog bandpass filters equal in number to notes, holding the respective peak outputs from those filters, and using the larger ones of the peak outputs as more powerful candidates for the components of a chord using a level detector.

The technique of using such analog filters has the problem that the result of the determination would be likely to fluctuate or be unstable due to the ambient temperature or that the circuit structure would be large-scaled, disadvantageously.

SUMMARY OF THE INVENTION

It is therefore an object of the present invention to provide a digitalized note detector which obtains respective notes of one or more input sounds in a short time, and operates in a stabilized manner on a small circuit scale, and an electronic musical instrument using such note detector.

According to one aspect of the present invention, there is provided a note detector comprising digital signal processing means for performing different-characteristic digital filtering operations on a digital waveform signal representing a given acoustic signal on a time divisional basis to detect the respective levels of spectra of frequencies corresponding to one or more notes contained in the given acoustic signal; and means for detecting the one or more notes contained in the given acoustic signal on the basis of the result of the digital filtering operations performed by the digital signal processing means.

According to the note detector, signal processing is all performed in a digital region.

More specifically, the digital filtering includes bandpass filtering with a frequency corresponding to each note as the central frequency. Alternatively, bandpass filtering may be performed by using two filters; a high-pass filter and a low-pass filter.

In a preferred embodiment, the digital signal processing means may perform a high-pass filtering operation with a predetermined characteristic and sequentially perform on a time divisional basis low-pass filtering operations one with a resonance having a peak at a frequency corresponding to each note.

The digital signal processing means detects the level of a signal waveform resulting from the digital filtering operation for each note. In an illustrative structure to detect such level, the envelope of a waveform signal resulting from each filtering operation is extracted. This processing may include, for example, extraction of a peak level of the waveform at predetermined intervals of time. According to a preferred embodiment, the absolute value of the waveform signal resulting from the filtering operation is taken and passed through a low-pass filter of a resonance type with a peak at a frequency of 0.

Thus, when one or more notes are obtained on a real time basis, the results may be used to in various applications. For example, each note may be displayed and/or printed. Alternatively, the resulting signals may sequentially be stored in a storage device, processed in a desired way, displayed and/or printed in the form of a score (musical paper). Alternatively, a tone based on the resulting signal may automatically be played by using a musical sound generator in the form of a specified musical sound, for example, a piano sound.

In an illustrative structure, a musical sound is generated from the musical sound signal generating means on a real time basis in response to the result of the detection. In this case, the musical sound may be output as one having a predetermined timbre simultaneously with the generation of the original acoustic signal with the same pitch as, or with a different pitch from, the original acoustic signal after detuning or transposing.

Preferably, such electronic musical instrument has a plurality of musical sound generating channels to which control means assigns notes on the basis of the result of the detection.

According to one illustrative structure of an electronic musical instrument of the present invention, when detecting means detects a note different from those allocated already to the predetermined number of musical sound generating channels, the control means allocates the present note to an empty one of the musical sound generating channels to start generation of the corresponding musical sound signal. When the detecting means detects no more notes allocated to the channels, it instructs the musical sound generating channel to stop the generation of the musical sound signal corresponding to that note.

It will be obvious to those skilled in the art that the present invention may have other structures, modifications and applications.

BRIEF DESCRIPTION OF THE DRAWINGS

Other objects and features of the present invention will be more clearly understood by those skilled in the art by reading the following detailed description of a preferred embodiment of the present invention, when taken together with the accompanying drawings.

In the FIGURES.

DETAILED DESCRIPTION OF THE PREFERRED EMBODIMENT

A preferred embodiment of the present invention will be described in more detail below with reference to the drawings.

Basic principles

Figure 1:
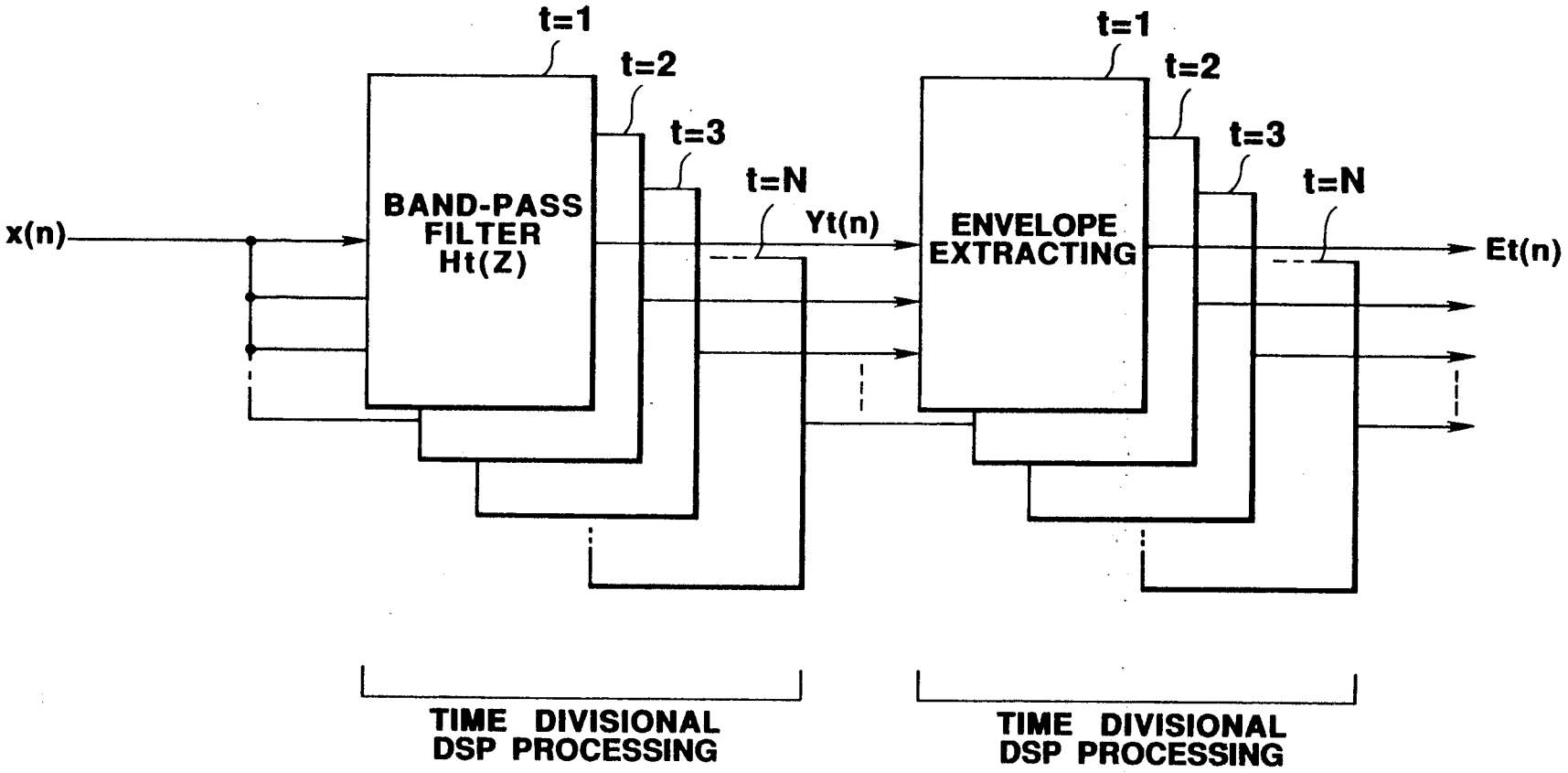
FIG. 1 is a schematic indicative of the basic principles of one embodiment of the present invention.

The basic principles of the preferred embodiment will first be described. FIG. 1 illustrates that a digital signal processor (below referred to as a DSP) constitutes N bandpass filters one having a band width corresponding to each note and also N envelope extracting circuits.

First, an input acoustic signal x(n) is converted to a digital signal (if the acoustic signal is originally a digital signal, it is used as it is). The signal x(n) is filtered by the N bandpass filters $H_t(z)$ by the time divisional processing by the DSP. At this time, the respective transfer functions of the bandpass filters are changed depending on the corresponding notes of each of a plurality of octaves.

Figure 2:
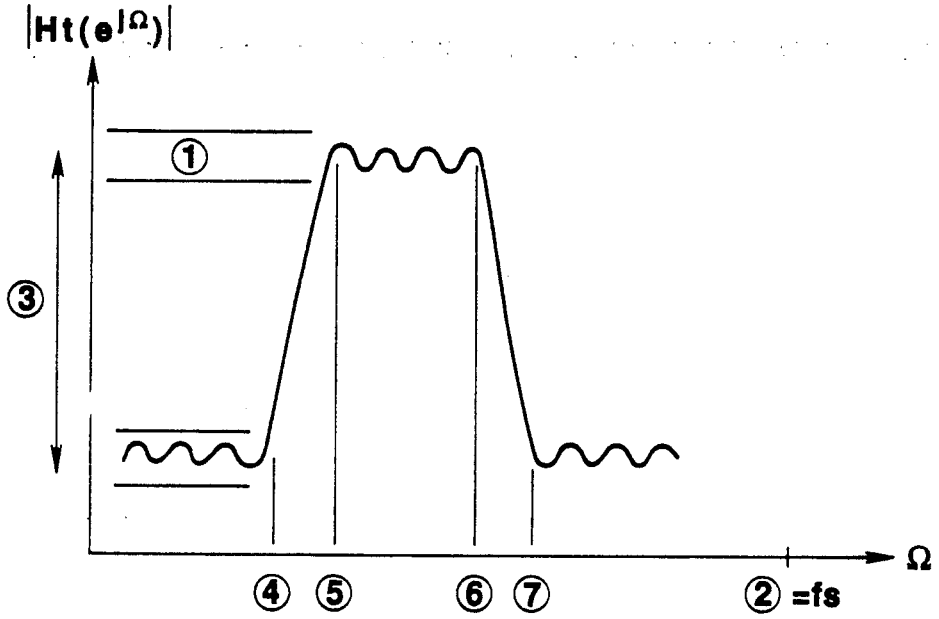
FIG. 2 is a frequency characteristic diagram of a bandpass filter $H_t(z)$ of FIG. 1.

FIG. 2 shows the frequency characteristic of a Chebyshev-type bandpass filter the transfer function of which is given by $$H_t(z) = H_t(0)_{i\pi} \frac{1 + b_{1t(i)}Z^{-1} + b_{2t(i)}Z^{-2}}{1 + a_{1t(i)}Z^{-1} + a_{2t(i)}Z^{-2}}$$

where t is a subscript designating each note.

If the bandpass filter with i=1 is constituted, the DSP performs the following operation given by $$Y_t(n)=H_t(0)(x(n)+b_{1t}x(n-1)+b_{2t}x(n-2))-(a_{1t}Y_t(n-1)+a_{2t}Y_t(n-2))$$

If $i \geqq 2$, an operation similar to the above equation is performed repeatedly.

The respective coefficients of each of the filters can numerically be calculated.

As a specified example, if two cascaded digital bandpass filters for i=1, 2 at $A_4$=440 Hz are constituted under the following conditions (①-⑦ are shown in FIG. 2), ① = 1 dB
② = (sampling frequency $f_s$) = 10 KHz
③ = 12 dB or more
④ = 415 Hz
⑤ = 430 Hz
⑥ = 450 Hz and
⑦ = 466 Hz, the following coefficient values of the digital filters are obtained:

$$H_{44Hz}(0)=0.08192384$$

and when $i=1$,
$a_1(1)=-1.91442200776$
$a_2(1)=0.99333673$
$b_1(1)=-1.91105345727$ and
$b_2(1)=1$:

when $i=2$,
$a_1(2)=-1.9210712$
$a_2(2)=0.993606$
$b_1(2)=-1.93525314797$ and
$b_2(2)=1$.

In this way, the operations for the bandpass filters are performed for each note on a time divisional basis and as a result, signals $Y_t(n)$ where t=1 to N are obtained.

The DSP then extracts the envelope of the signals $Y_t(n)$ on a time divisional basis by calculating the respective peak levels (absolute values) of waveforms $Y_t(n)$ at predetermined intervals of time (for example, for the pitch periods corresponding to the respective notes). Alternatively, the envelope is obtained by performing a particular digital filtering operation on the absolute value signal $|Y_t(n)|$ as will be described later in more detail.

By such DSP time divisional processing, the respective envelope signals $E_t(n)$ where t=1 to N for the corresponding notes are calculated, a CPU such as a microcomputer determines the respective levels of the outputs to detect one or more note signals contained in the original input waveform signal x(n).

While the basic principles are to perform the filtering operations with the bandpass filters having peaks for the respective notes on a time divisional basis, the bandpass filtering may be realized by various types of digital filters having similar functions without relying on Chebyshev characteristic bandpass filters. Alternatively, the bandpass filters may be realized by cascaded low- and high-pass filters.

One principle of reducing the number of multiplications when the filtering operations are performed to facilitate filtering on a real time basis will be described below. (Eight multiplications are required in the above example of the Chebyshev type bandpass filters for $A_4=440$ Hz.)

Improved principles

Figure 3:
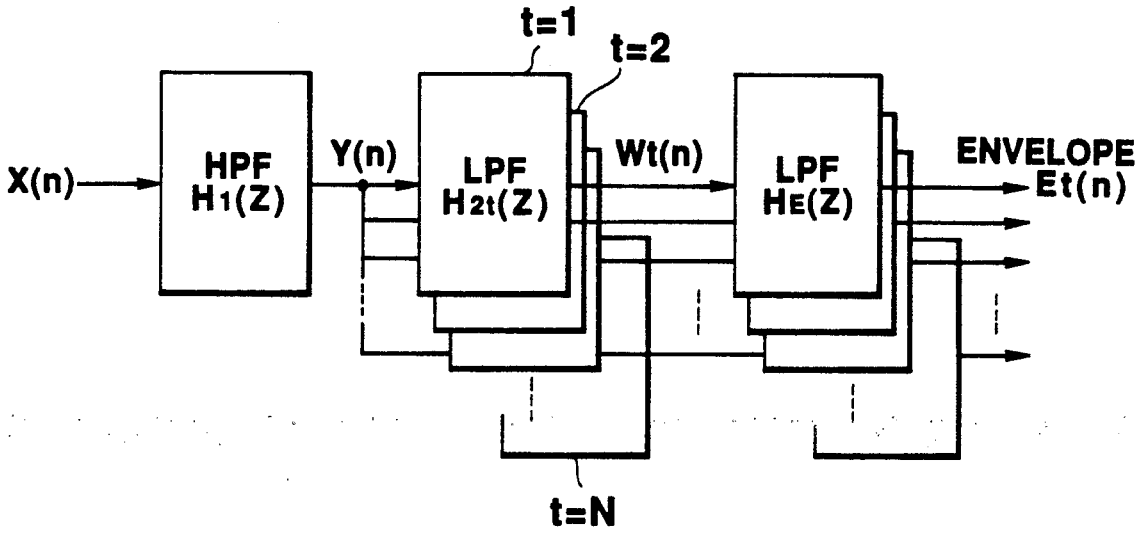
FIG. 3 is a schematic of improved versions of the basic principles of the embodiment of FIG. 1.

FIG. 3 illustrates the improved principles on which the DSP performs a digital filtering operation where the number of multiplications is reduced.

First, an input acoustic signal x(n) in the form of a digital representation is input to a high-pass digital filter $H_1(z)$ where x(n) is 0 at a frequency of 0 and maximum at a frequency of $f_s/2$. The structure of the filter will be described in more detail later. The output Y(n) of filter $H_1(z)$ is applied to low-pass filters $H_{2t}(z)$ which act for the corresponding notes t on a time divisional basis. Low-pass filters $H_{2t}(z)$ each have the characteristic of a resonance type low-pass filter having a peak at a note frequency, as will be described in more detail later.

Figure 4:
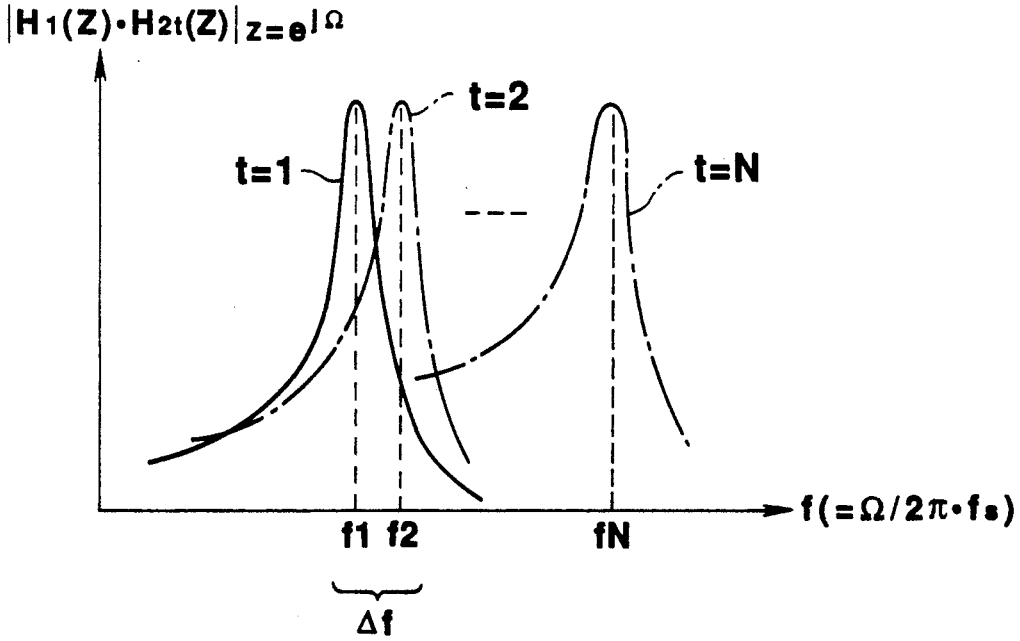
FIG. 4 is a frequency characteristic diagram of cascaded high- and low-pass filters $H_1(z)$ and $H_{2t}(z)$ of FIG. 3.

Therefore, the frequency characteristic of a filter which includes cascaded high- and low-pass filters $H_1(z)$ and $H_{2t}(z)$ is a pseudo-bandpass filter as shown in FIG. 4.

In FIG. 4, $f_1, f_2, \ldots, f_N$ correspond to the note frequencies, and N may be selected to be about 40–50 (three octaves to four octaves). Of course, when a note is to be detected in a wider octave range, either a high-speed DSP or a plurality of DSPs for concurrent processing may be used for that purpose.

The outputs $W_t(n)$ of low-pass filters $H_{2t}(z)$ where t=1 to N are applied to low-pass filters $H_E(z)$ which operate for the respective notes on a time divisional basis. The characteristics of filters $H_E(z)$ will be described in more detail later. The respective outputs $E_t(n)$ will be the envelope signals for the corresponding notes. The subsequent processing is similar to that described concerning the basic principles.

The structures and characteristics of the respective digital filters of FIG. 3 will be described below in more detail.

High-pass filter $H_1(z)$

Figure 5:
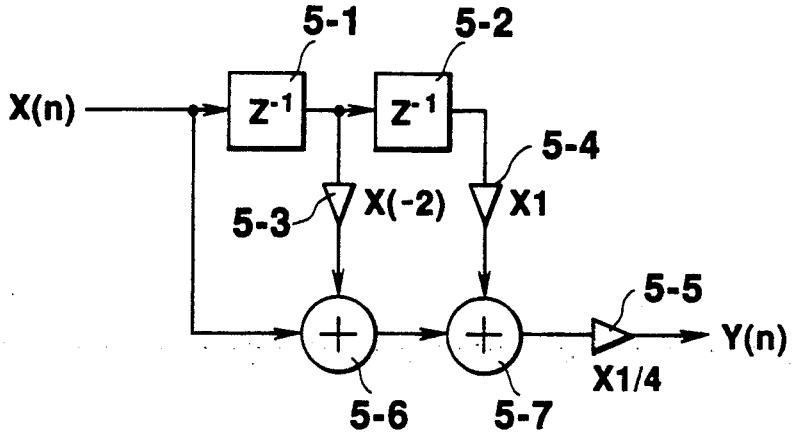
FIG. 5 is a schematic of the high-pass filter $H_1(z)$ of FIG. 3.

FIG. 5 shows an illustrative structure of high-pass filter $H_1(z)$ which is a second-order FIR digital filter the transfer function of which is given by $$H_1(z) = \frac{1}{4}(1 - 2Z^{-1} + Z^{-2})$$

In FIG. 5, the numeral 5-1, 5-2, each denote a delay element; 5-3, 5-4, 5-5 each, a multiplier; and 5-6, 5-7 each, an adder. When this high-pass filter is realized by the operation of DSP, the following is executed:

$$Y(n) = \frac{1}{4}(x(n) - 2x(n-1) + x(n-2)) \quad (1)$$

In this case, the multiplication of a coefficient and a signal can be realized by a mere shift operation.

Figure 6:
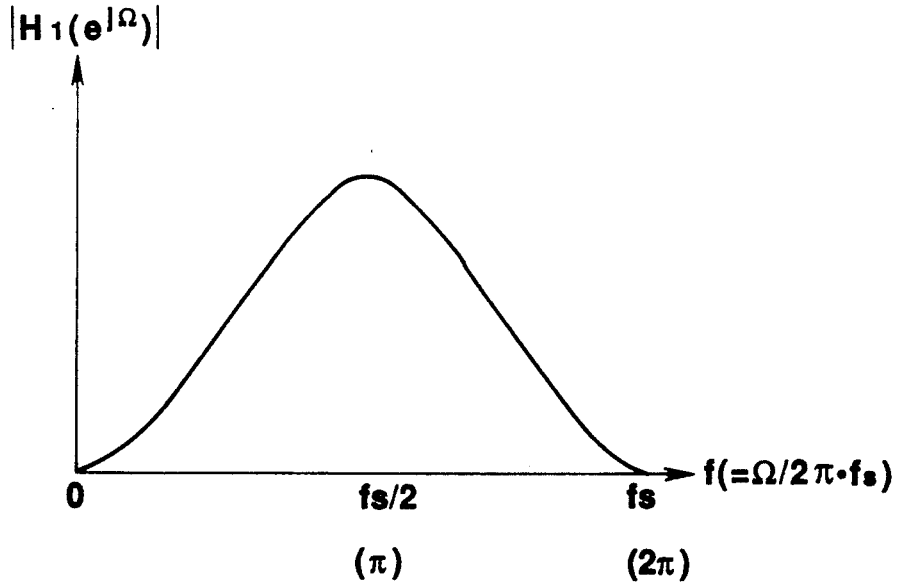
FIG. 6 is a frequency characteristic diagram of the high-pass filter $H_1(z)$ of FIG. 5.

The frequency characteristic of the high-pass filter is given by $$|H_1(e^{j\Omega})|^2 = \frac{1}{16}|(1 - 2e^{-j\Omega} + e^{-2j\Omega})|^2 = \frac{1}{16}(6 + 2\cos 2\Omega - 8\cos\Omega)$$

where the characteristic is minimum at $\Omega=0$ (at a frequency of 0 Hz) and maximum at $\Omega=\pi$ ($f_s/2$ Hz). FIG. 6 shows such characteristic.

Low-pass filter $H_{2t}(z)$

Figure 7:
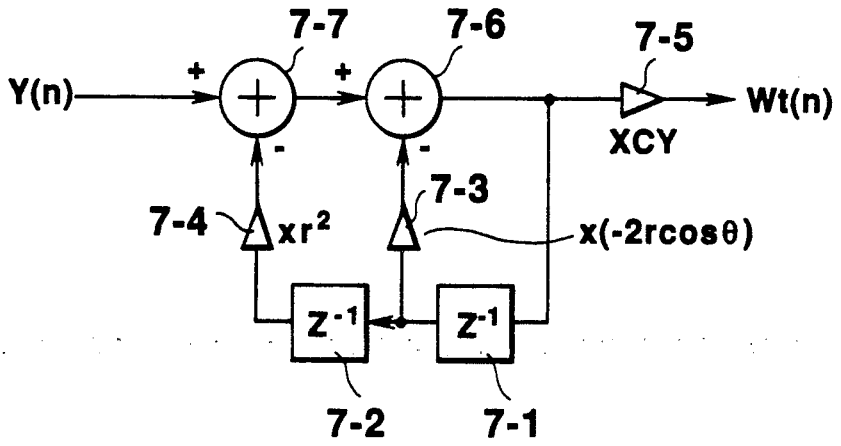
FIG. 7 is a schematic of the low-pass filter $H_{2t}(z)$ of FIG. 3.

FIG. 7 shows an illustrative structure of low-pass filter $H_{2t}(z)$ which is a second-order IIR digital filter, the transfer function of which is given by $$H_{2t}(z) = CY \cdot \frac{1}{1 - 2r\cos\theta\, Z^{-1} + r^2 Z^{-2}}$$

As will be understood later, $\theta$ and CY change depending on the subscript t indicative of a note. The character r is a parameter indicative of the intensity of the resonance (or the degree of a peak).

In FIG. 7, the numerals 7-1, 7-2 each denote a delay element; 7-3, 7-4, 7-5 each, a multiplier; and 7-6, 7-7 each, an adder. When this low-pass filter is realized by the operation of the DSP, the following is executed:

$$W_t(n) = CY \cdot Y(n) + 2r\cos\theta\, W_t(n-1) - r^2 W_t(n-2) \quad (2)$$

Figure 9:
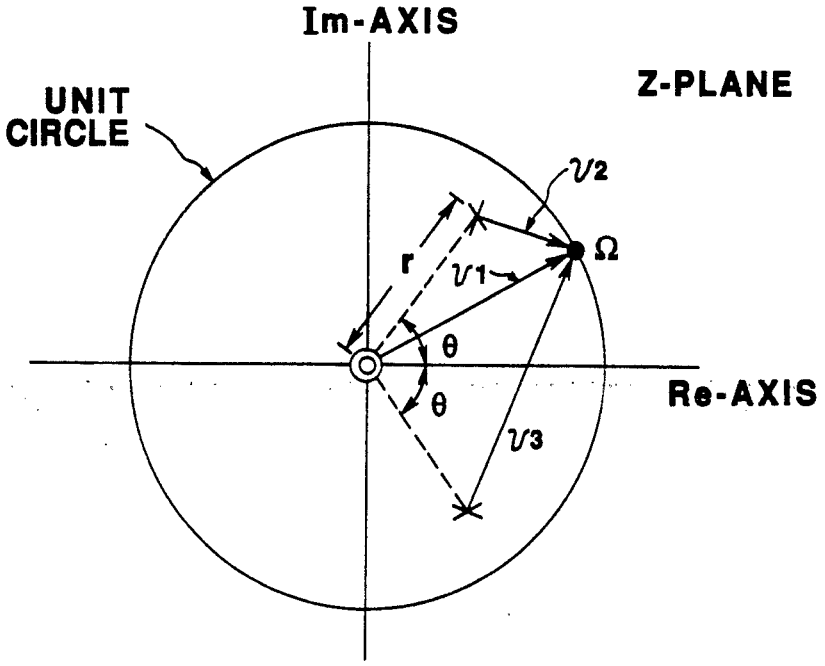
FIG. 9 is a diagram indicative of a pole, a zero point, a polar vector and a zero-point vector of the digital filter of FIG. 7.
Figure 10:
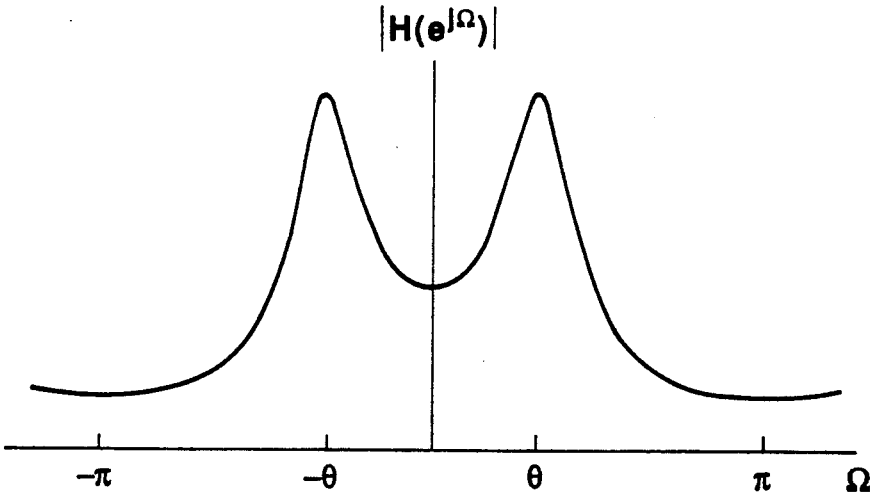
FIG. 10 is a frequency characteristic diagram related to FIG. 9.

The frequency characteristic of the low-pass digital filter is given by $$H_2(e^{j\Omega}) = CY\frac{1}{1 - 2r\cos\theta\, e^{-j\Omega} + r^2 e^{-2j\Omega}} = CY\frac{1}{[1 - (re^{j\theta})e^{-j\Omega}][1 - (re^{-j\theta})e^{-j\Omega}]}$$

where the poles of the transfer function are at:

$$Z_1 = re^{j\theta}, Z_2 = re^{-j\theta}$$

and a double zero point lies at Z=0. FIG. 9 shows the disposition of the poles, zero points, and the polar and zero-point vectors for $0<\theta<\pi/2$. As will be understood in FIG. 9, the length of vector $v_2$ decreases initially as $\Omega$ moves along a unit circle from $\Omega=0$ to $\Omega=\pi$ and then increases. The minimum length of vector $v_2$ is in the vicinity of a pole ($re^{j\theta}$). It is known that the magnitude of a frequency response at frequency $\Omega$ is the ratio in length of zero-point vector $v_1$ to vector $v_2$ and that the phase of the frequency response is the angle between the real axis and vector $V_1$ minus the angle between the real axis and vectors $V_2$. FIG. 10 shows only the amplitude characteristic.

The magnitude of the frequency response (amplitude characteristic) is inversely proportional to the magnitude of polar vector $V_2$ and maximum at $\Omega$ in the vicinity of $\theta$, which is also shown in FIG. 10. The sharpness of this peak is determined depending on the magnitude of r. A filter having a sharp peak (resonance characteristic) in the vicinity of r=1 is thus realized.

Figure 8:
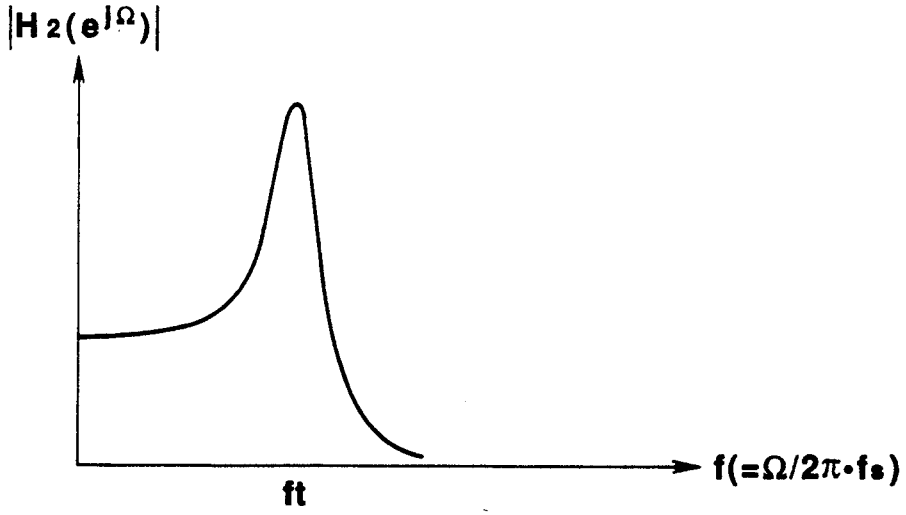
FIG. 8 is a frequency characteristic diagram of the low-pass filter $H_{2t}(z)$ of FIG. 7.

As will be clear from the above examination, if the value of $\theta$ which is $2\pi f_t/f_s$ is determined for each note, a low-pass digital filter of a resonance type with a peak at a note frequency $f_t$ is realized, as shown in FIG. 8. In this case, r and CY can experimentally or mathematically be obtained such that r has a magnitude which does not influence the level of the next note and that CY results in equal level outputs $W_f(n)$ at the corresponding notes.

If, for example, the ratio in magnitude of the frequency response at the note frequency $f_f$ of f to that at the note frequency $f+\Delta f$ (or $f_{f+1}$) which is spaced from $f_f$ by $\Delta f$ is required to be m:1, the following quartic equation:

$$|H_2(e^{j2\pi f/f_s})|^2/|H_2(e^{j2\pi(f+\Delta f)/f_s})|^2=m^2$$

is required to be solved with respect to r and one of the resulting r's which satisfy $0<r<1$ is selected to calculate the respective coefficients $-2r\cos\theta$ and $r^2$. As a result of the calculation, for example, if $f_s=5$ KHz, f=440 Hz and m=4, $-2r\cos\theta=-1.9773$, $r^2=0.9851$ and CY =36.7. This process applies for other notes.

Low-pass filter $H_E(z)$

Figure 11:
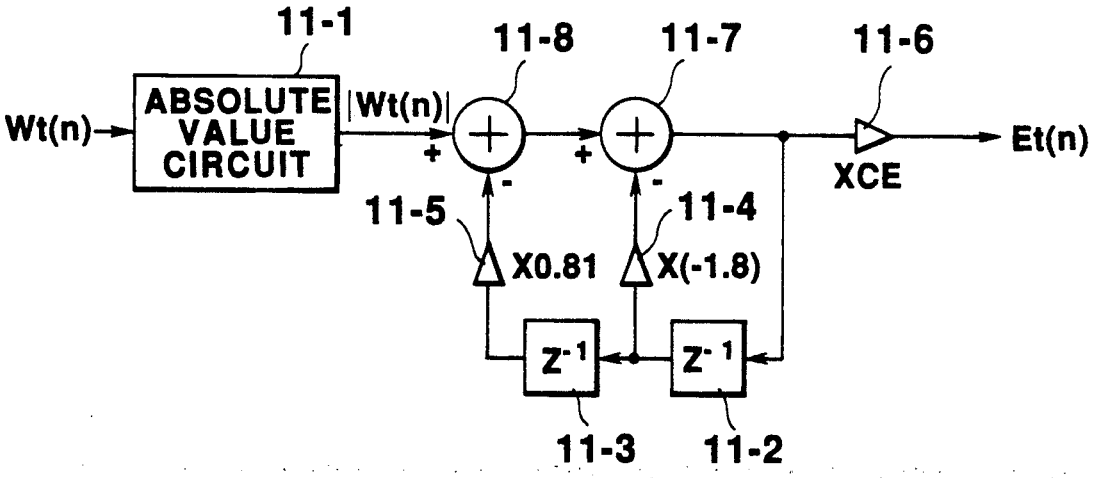
FIG. 11 is a schematic of the low-pass filter $H_E(z)$ of FIG. 3.

FIG. 11 shows an illustrative structure of a low-pass filter $H_E(z)$ which is a second-order IIR digital filter of the same type as the low-pass filter $H_{2f}(z)$ described above. The transfer function of filter $H_E(z)$ is given by $$H_E(z) = CE \cdot \frac{1}{1 - 1.8Z^{-1} + 0.81Z^{-2}}$$

This transfer function is obtained by substituting r=0.9 and $\theta=0$ into the above low-pass filter $H_{2f}(z)$.

In FIG. 11, the numeral 11-1 denotes an absolute value circuit which provides the absolute value of input signal $W_f(n)$ which is the output signal from low-pass filter $H_{2f}(z)$ and the resulting output $|W_f(n)|$ is digitally filtered. The numerals 11-2, 11-3 each denote a delay element; 11-4, 11-5, 11-6 each, a multiplier; and 11-7, 11-8 each, an adder. When this low-pass filter is realized by the operation of the DSP, the following equation $$E_f(n)=CE|W_f(n)|+1.8E_f(n-1)-0.81E_f(N-2) \quad (3)$$

is executed.

Figure 12:
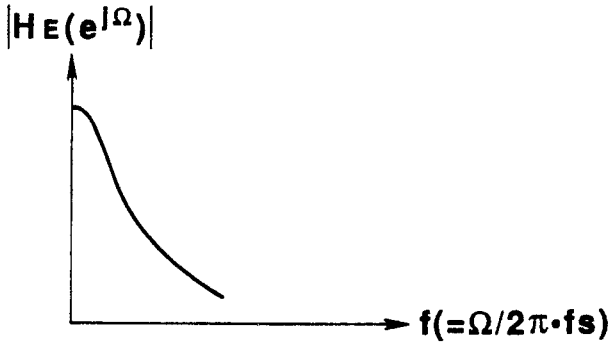
FIG. 12 is a frequency characteristic diagram of the low-pass filter $H_E(z)$ of FIG. 11.

This low-pass filter has a resonance or amplitude type frequency characteristic which has a peak at $\theta=0$, as will be obvious from the above description and shown in FIG. 12 where the coefficient CE is a factor to make uniform the respective levels of the notes and can be obtained, for example, experimentally when required.

Figure 13:
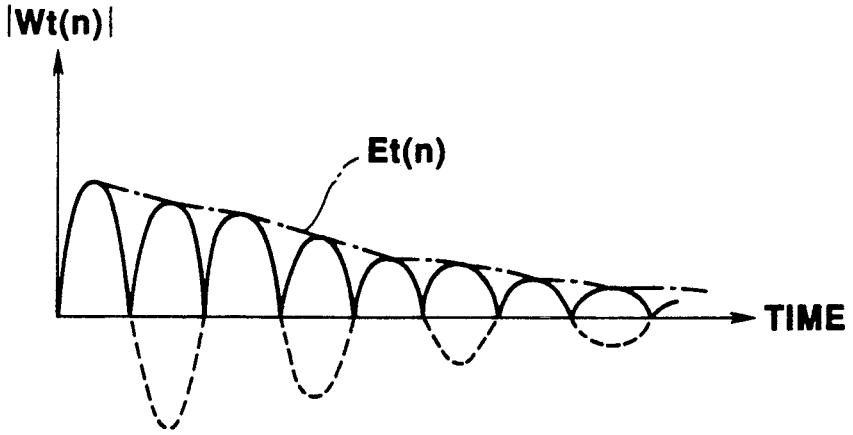
FIG. 13 illustrates the extraction of an envelope using the structure of FIG. 11.

FIG. 13 schematically illustrates an envelope signal $E_f(n)$ obtained from the structure of FIG. 11. The absolute value circuit 11-1 converts the negative crest values (shown by the broken lines in FIG. 13) to the corresponding positive crest values, which are then subjected to low-pass filtering, so that the filter eventually provides the DC component of the waveform signal $|W_f(n)|$.

The entire structure of an embodiment

Since the principles of the present invention have been described above, the specified structure of an embodiment thereof will be described below more specifically.

Figure 14:
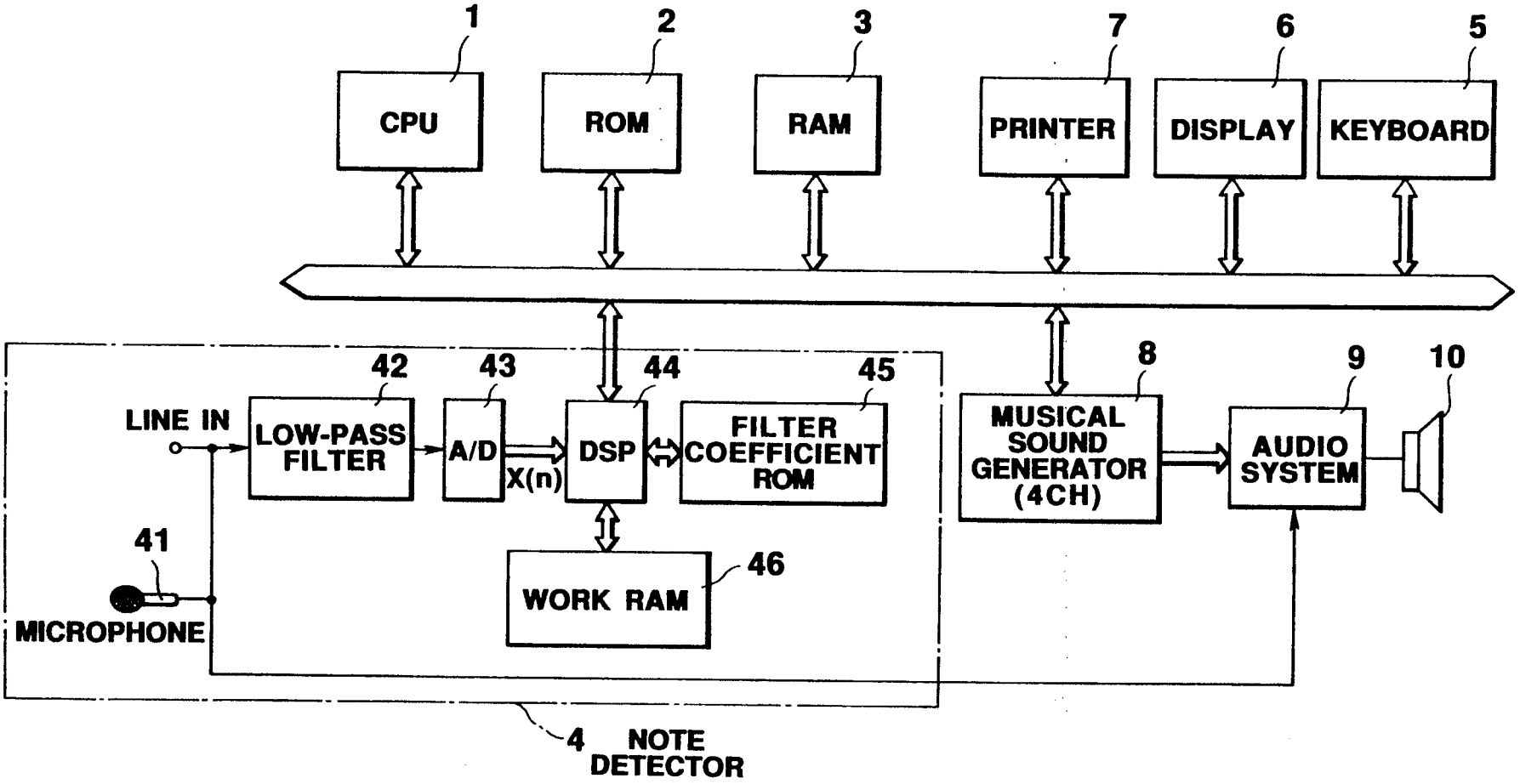
FIG. 14 is a schematic of the entire circuit of an embodiment.

FIG. 14 illustrates the entire structure of the embodiment where CPU 1 controlls the entire system. The operation of CPU 1 is controlled by a program stored in ROM 2 to perform various operations using RAM 3. In a musical sound detector 4, an acoustic signal which may be a musical instrument sound, a human voice or a reproduced sound from a tape recorder, a radio, a television set or a CD player received through a microphone 41 or a line input LINE IN is appropriately filtered by low-pass filter 42, converted by A/D converter 43 to digital signal x(n) using an appropriate sample frequency $f_s$ and then delivered to DSP (digital signal processor) 44. DSP 44 processes signals using filter coefficient ROM 45 which stores various coefficients for digital filtering purposes, and work RAM 46 which stores input waveform signals x(n) and data for filtering purposes.

The result of the signal processing by DSP 44 is delivered to CPU 1 which uses those data for providing various control operations. CPU 1 is connected through a bus to the elements 2–4 as well as to key-board 5, display 6, printer 7 and musical sound generator 8 for controlling them.

Keyboard 5 has function switches as well as performance keys, the operation of which can be detected by CPU 1 to allocate musical sounds to be generated to musical sound generator 8.

Display 6 and printer 7 display and print, respectively, one or more notes detected by note detector 4 under control of CPU 1. For example, the notes contained in input sounds on a real time basis may be displayed or may be compiled, displayed and/or printed as a musical score.

Musical sound generator 8 has a plurality of musical sound generating channels. Assume that it has 4 channels, for example. The output musical sound signal from musical sound generator 8 is output from speaker 10 through audio system 9 to which the signals from microphone 41 and/or line LINE IN are also applied so as to be acoustic outputs when required.

Various types of sound source circuits may be used as the musical sound generator 8; for example, PCM systems, FM systems, iPD systems, sinusoidal waveform synthesizing systems, etc. Musical sound generator 8 is able to generate a musical sound signal having a timbre specified by keyboard 5. In this case, CPU 1 allocates a note which is to be output in order to perform a musical sound generation.

For example, CPU 1 allocates the note, detected by note detector 4, to musical sound generator 8 on a real time basis for generating the corresponding sound. In that case, the sound can be generated with a pitch slightly different from that of the original sound or it can be generated with a transposition.

Alternatively, CPU 1 can sequentially store changes in the notes, detected by note detector 4, in RAM 3 as sequencer data, and sequentially reads such sequencer data in response to, for example, a play start command from keyboard 5 to thereby generate the corresponding musical sound signals from musical sound generator 8.

CPU 1 may perform various operations in accordance with the contents of the programs stored in ROM 2.

Structure of DSP

Figure 15:
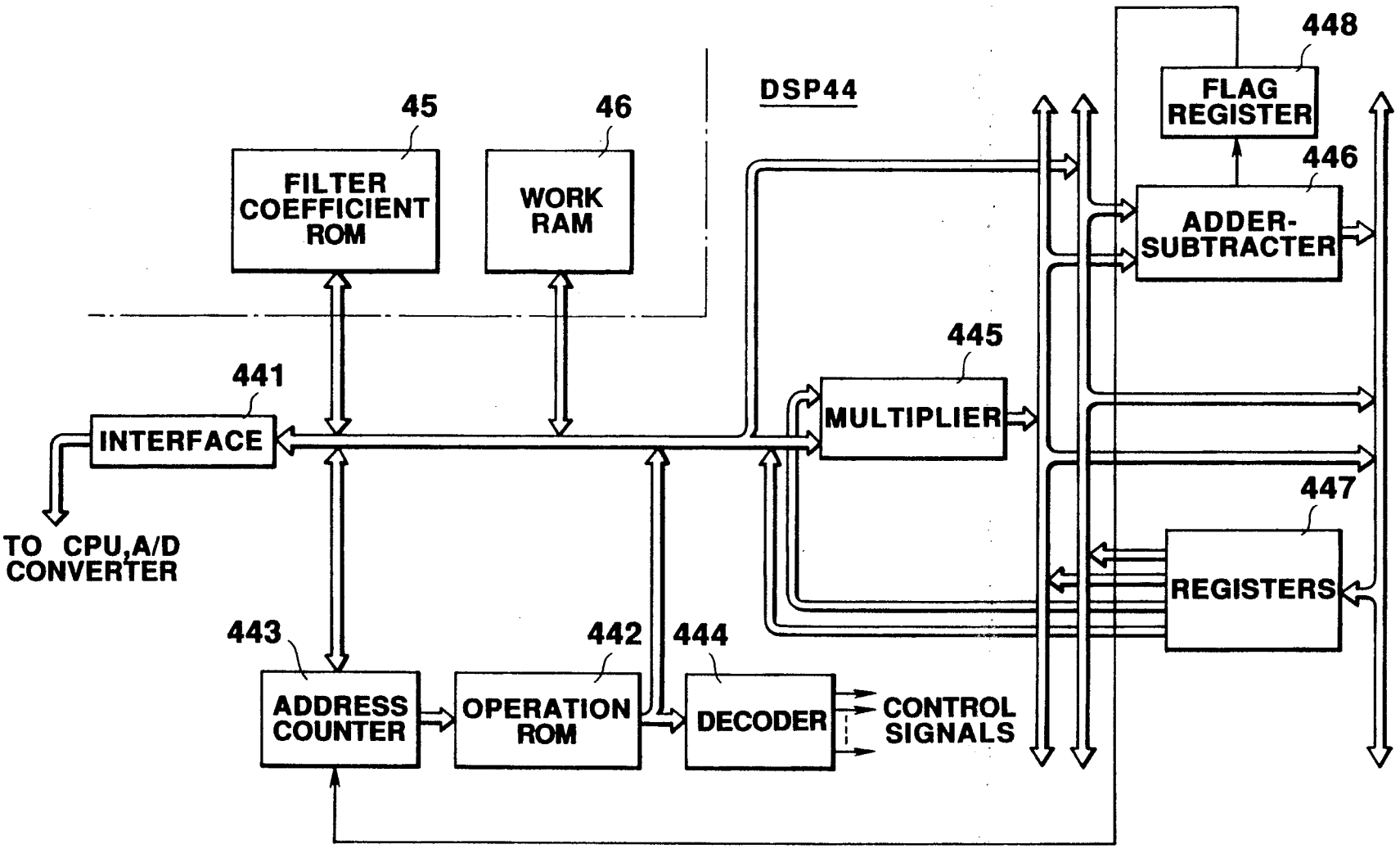
FIG. 15 is a schematic of the internal circuit of a DSP of FIG. 14.

FIG. 15 shows an illustrative structure of DSP 44 which is connected through interface 441 to CPU 1 and A/D converter 43. Operation ROM 442 controls the operation of DSP 44. Address counter 443 accesses operation ROM 442 for sequential operations.

CPU 1 instructs DSP 44 to read what operation program it should read from operation ROM 442 to process signals. The output from operation ROM 442 is also delivered to decoder 444 which outputs various control signals to open/close the gates and latches in DSP 44 to perform desired signal processing operations.

Filter coefficient ROM 45 and work RAM 46 are connected to a bus in DSP 44. Thus, coefficient data and waveform signals are delivered to DSP 44 or written into work RAM 46 when required in accordance with the program in operation ROM 442.

DSP 44 further includes multiplier 445 and adder-subtracter 446 for calculating purposes and connected to the bus in the form of a 2-input and 1-output configuration. Register group 447 includes a plurality of registers which stores intermediate data in the course of calculation and is connected to the input/output terminals of multiplier 445 and adder-subtracter 446 through the bus.

DSP 44 delivers to address counter 443 a flag signal indicative of the result of the determination through flag resistor 448 in order to make a determination in accordance with the results of the calculation from adder-subtracter 446. An operation signal, etc., read from operation ROM 442 are changed depending on the output of flag register 448.

Note detection

Figure 16:
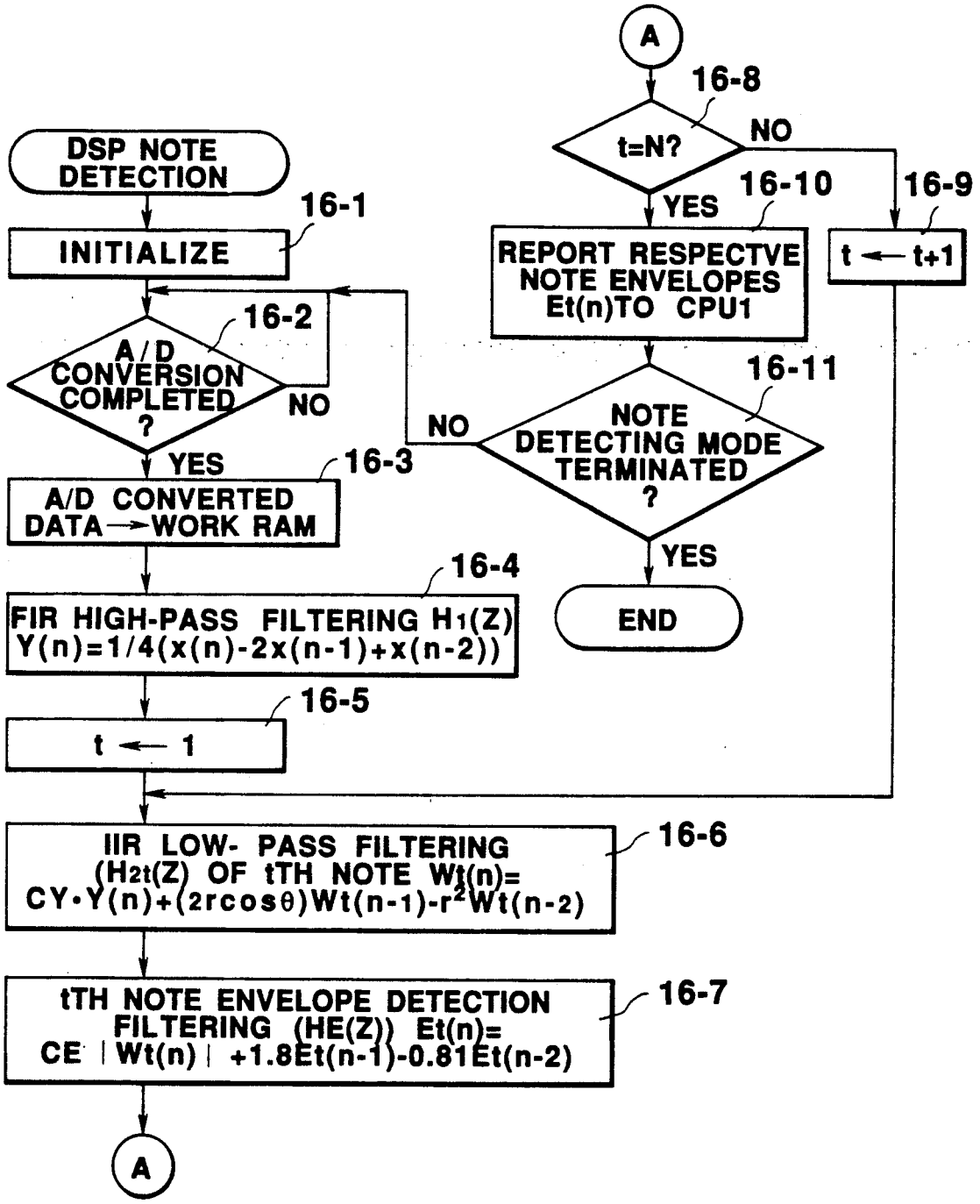
FIG. 16 is a flowchart indicative of the operation of the DSP of FIG. 14.
Figure 17:
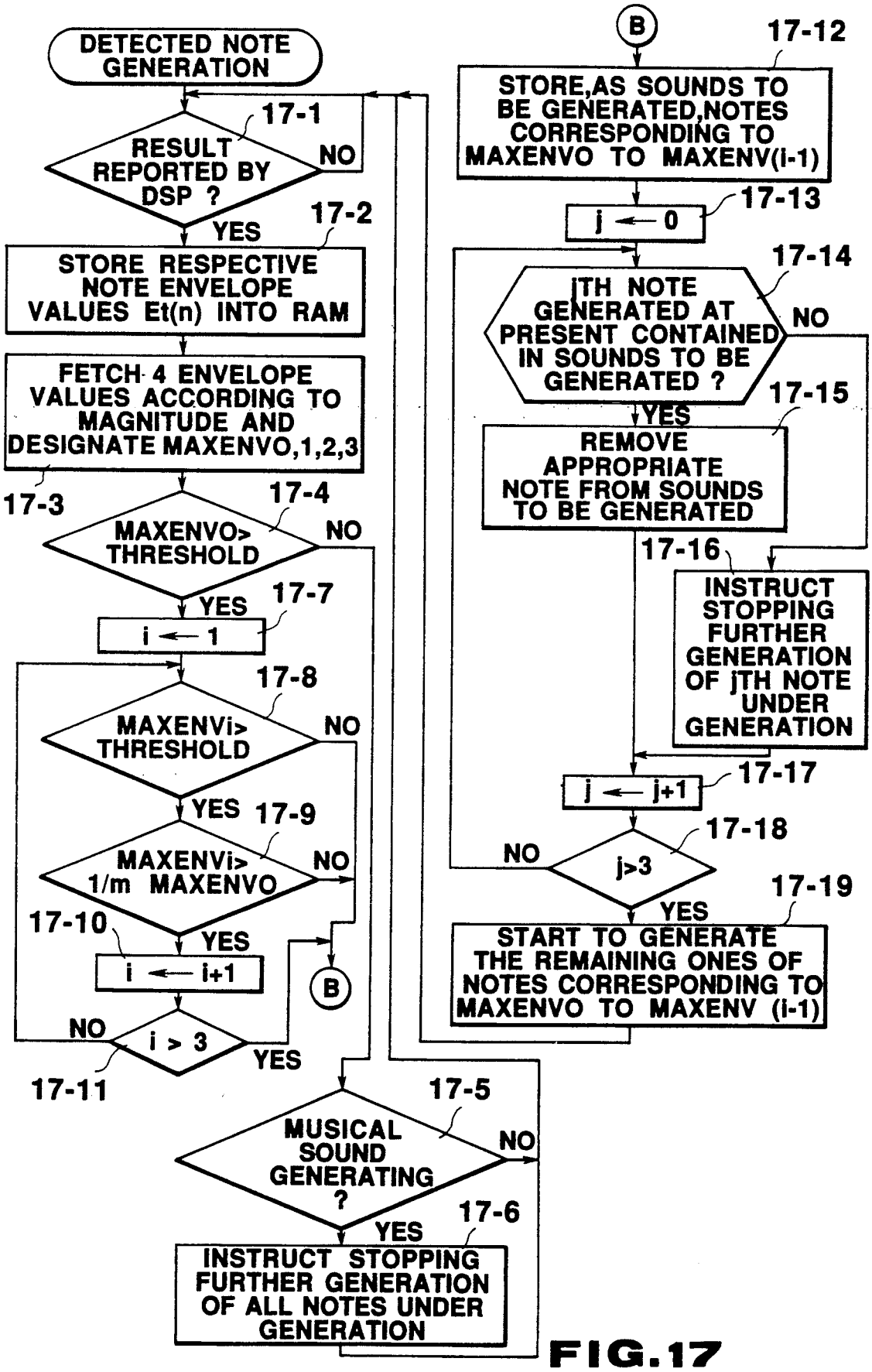
FIG. 17 is a flowchart indicative of the operation of a CPU of FIG. 14.

The operation of the present embodiment will now be described. First, note detection by note detector 4 will be described. FIG. 16 shows a flowchart indicative of the operation of DSP 44 in accordance with operation ROM 442. When DSP 44 starts note detection in accordance with a command from CPU 1, it performs initialization (16-1) to clear work RAM 46 mainly.

DSP 44 waits for the termination of A/D conversion at sample periods from A/D converter 43 (16-2). When it receives a signal indicative of such determination, it stores the A/D converted input signals into work RAM 46 while sequentially incrementing the address. If a particular area of work RAM 46 is used as a ring buffer (constituted by connecting the starting and terminating ends of the area virtually), a limitless input signal can be stored therein. The input signal will be the signal x(n) (see FIG. 3). DSP 44 then performs the FIR high-pass filtering operation with $H_1(z)$ (16-4) in accordance with equation (1) on the input x(n) received this time as well as the last input x(n−1) and the last but one input x(n−2) which are read from work RAM 46, using multiplier 445 and adder-subtracter 446 of DSP 44.

Subsequently, DSP 44 performs initial setting t=1 for IIR low-pass filtering with $H_{2t}(z)$ for each note (16-5), and then the actual filtering operation (16-6) in accordance with equation (2) using multiplier 445 and adder-subtracter 446 of DSP 44 while reading the respective coefficients CY, 2r cos $\theta$ and $r^2$ from filter coefficient ROM 45. The results $W_t(n)$ of those calculations are sequentially stored into another particular area of work ROM 46 used as a ring buffer. By doing so, DSP 44 reads $W_t(n-1)$, $W_t(n-2)$, . . . , from the buffer for use in operations.

Subsequently, DSP 44 performs IIR low-pass filtering with $H_E(z)$ to detect the envelope of each note (16-7) by reading the respective coefficients CE, 1.8, −0.81 from filter coefficient ROM 45 using multiplier 445 and adder-subtracter 446 of DSP 44 in accordance with equation (3). Among these operations, DSP 44 also performs calculation of the absolute value $|W_t(n)|$ using adder-subtracter 446.

DSP 44 sequentially stores the results of these operations $E_t(n)$ into another particular area 46 of work RAM 46 used as a ring buffer. By doing so, DSP 44 can sequentially read $E_t(n-1)$, $E_t(n-2)$, . . . for use in operations.

Sequentially, it determines whether t=N to see if these detecting operations have been performed for all the notes (16-8). If the answer is NO, DSP 44 increments t (16-9) and then performs filtering operations again at steps 16-6 and 16-7.

When these filtering operations have been performed for all the notes, DSP 44 reports to CPU 1 the respective envelopes $E_t(n)$ where t=1 to N for the notes (16-10) for preparation for the next A/D conversion (16-2).

Namely, DSP 44 repeatedly performs three different digital filtering operations sequentially on a time divisional basis for each note at each interval of sampling to thereby detect the respective envelopes of the notes and hence the respective levels of the frequency spectra of frequencies corresponding to the notes on a real time basis.

When CPU 1 reports the termination of the note detecting mode to DSP 44 through operation of keyboard 5, DSP 44 terminates the series of operations (16-11).

Generation of a detected note by CPU 1

As mentioned above, CPU 1 receives from DSP 44 envelope signals $E_t(n)$ where t=1 to N for the respective notes and hence the levels of the frequency spectra of frequencies corresponding to the respective notes at each period of sampling, so that these signals may be used for various purposes.

One application directed to the generation of a musical sound signal from musical sound generator 8 on a real time basis will be described below.

CPU 1 first determines whether it has received an envelope signal from DSP 44 (17-1). If the answer is YES, CPU 1 writes the envelope signal value into RAM 3 (17-2). The CPU fetches the four greatest received envelopes and designates them as MAXENV0, 1, 2 and 3 (17-3).

Subsequently, CPU 1 determines whether the greatest envelope value MAXENV0 has exceeded a predetermined threshold value (17-4).

Assume now that input signal x(n) delivered from A/D converter 43 to DSP 44 is set, for example, to a maximum of ±100 and that envelope value $E_t(n)$ delivered from DSP 44 to CPU 1 is, for example, 1000 when only one note is received for that maximum value. In the case of two input notes, the respective note inputs are ±50, and the envelope value is 500 for the respective notes. Similarly, in the case of four input notes, the envelope value is 250 for the respective input notes. If this threshold value is set to an excessively large one, any note of a plurality of sounds input may not be detected. Therefore, the maximum envelope value (=1000)÷N(=50)=20 is set as a threshold value where N is the number of notes to be extracted.

If this threshold value is not exceeded, control passes to step 17-5 where CPU 1 determines whether there is a sound which is being generated (whether there is a note signal under generation by using note generator 8). If the answer is NO, CPU 1 prepares for a next input of envelope $E_t(n)$ where t=1 to N from the DSP 44 (17-1). If note generator 8 generates some note signal, CPU 1 determines that an acoustic input comprising that note from microphone 41 or line LINE IN has disappeared and instructs musical sound generator 8 to stop further generation of the musical sound (17-6).

If the maximum value MAXENV0 of the envelope has exceeded the threshold value, CPU 1 determines how many musical sound should be generated. To this end, first, i is set to i=1 (17-7). CPU 1 then checks whether MAXENVi (hence, in this case, the second largest envelope value MAXENV1) has exceeded the threshold value (17-8) and is larger than 1/m of the maximum envelope value MAXENV0 (17-9). Only when both the conditions are satisfied, i is incremented (17-10). Similarly, determinations at steps 17-11, 17-8 and 17-9 are repeated until determination for the four envelope values is terminated. If the answer is NO at steps 17-8 and 17-9 or if the four envelopes MAXENVi where i=0 to 3 satisfy conditions 17-8 and 17-9, control passes to step 17-12.

A supplementary explanation of determination at step 17-9 will be given. The character m denotes a factor to determine the degree of the level, to be cut, of the note next to the input note. According to the principles of the present invention, when a note is received, the envelope value of the next note will increase more or less (can leak). Therefore, CPU 1 determines whether the appropriate note is received, using the value of m used in the design of a digital filter of $H_{2r}(z)$.

Of course, the value of m may be used by experimentally obtaining conditions under which no errors are involved. In addition, determinations at steps 17-8 and 17-9 may be modified in various manners. At any event, correct determination of a note is required.

When control has passed to step 17-12, it has been determined that notes corresponding to envelopes the number of which is determined in accordance with the value of i are to be generated. Therefore, CPU 1 stores the notes for these envelopes as being generated. Musical sound generator 8 then compares these notes with the extracted notes which are the origins of musical sound signals now under generation to start a process for changing the channel allocation when required.

More specifically, CPU 1 resets a number j to designate each musical sound generating channel (17-13), determines whether the note which is the origin of the musical sound generated in the jth musical sound generating channel is contained in a maximum of four notes to be generated and extracted now (17-14). If the answer is YES, no changes are required in the jth musical sound generating channel (the musical sound now under generation is only required to continue to be generated). Therefore, the present extracted note is removed from the objects which are to be generated newly (17-15). If the answer is NO at step 17-14, the note which is the origin of the musical sound which has been generated by the jth musical sound generating channel is not contained in the sound received this time, so that CPU 1 instructs the jth musical sound generating channel to stop further generation of the sound.

CPU 1 makes such determination and provides such control over all the four musical sound generating channels (17-17, 17-18). As a result, CPU 1 allocates to empty musical sound generating channels musical sounds corresponding to the notes remaining unprocessed or to notes extracted newly this time for sound generation (17-19).

After that series of procedures, control returns to step 17-1 to wait for a new input of the next envelope value from DSP 44.

Figure 18:
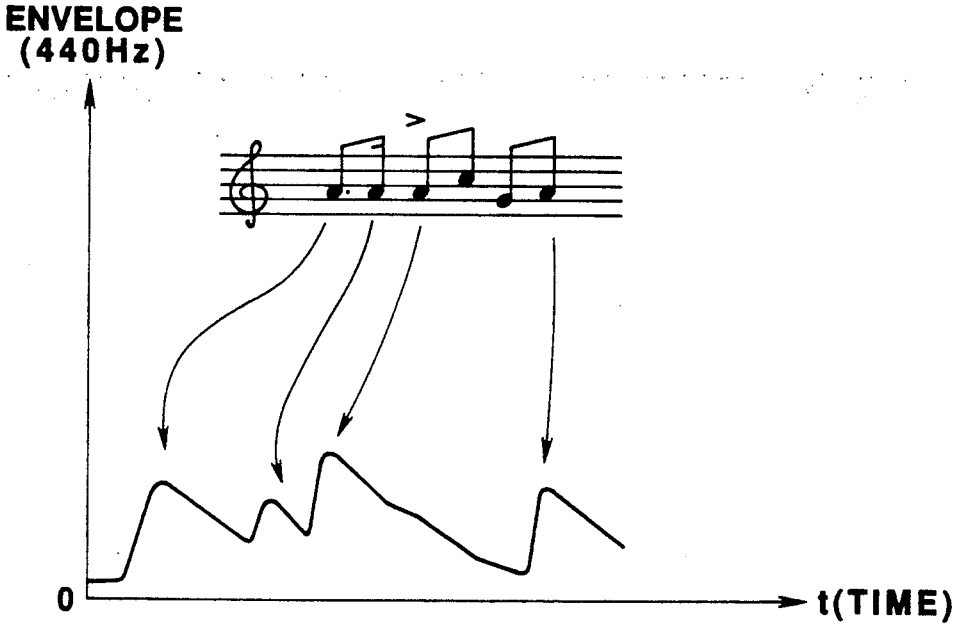
FIG. 18 illustrates the operation of the embodiment.

Therefore, for a melody shown in FIG. 18, CPU 1 receives from DSP 44 an envelope value changing with time (FIG. 18 shows an example of $A_4$=440 Hz). Therefore, CPU 1 starts generation of a sound from a time when conditions 17-4, 17-8 and 17-9 are satisfied. Conversely, when these conditions become not satisfied, further generation of the sound is stopped. Up to four musical sounds each having a designated tone can be generated on a real time basis in response to the input sound. Of course, the number of musical sounds to be generated can be set to any value.

According to the present invention, as mentioned above, detection of the presence/absence of each note is performed by digital signal processing, so that the stability of the circuit is ensured and the circuit is prevented from becoming large-sized. Detection of a plurality of input sounds (including a chord) is made with high accuracy. As a result, various musical applications are provided.

While the several embodiments of the present invention have been described in detail, they are only for illustrative purposes. The present invention may take various configurations including all modifications and applications which fall within the scope of the present invention which should be determined only by appended claims and their equivalents.

What is claimed is:

1. A musical instrument, comprising:

means for receiving an acoustic signal to output a digital waveform signal representing said acoustic signal;

digital signal processing means for sequentially performing (i) digital bandpass filtering operations on said digital waveform signal carried out on a time divisional basis using center frequencies corresponding to respective notes, and (ii) extracting operations to extract envelopes of waveform signals resulting from the bandpass filtering operations to detect respective levels of spectra of frequencies corresponding to said notes;

detecting means coupled to said digital signal processing means for detecting at least one note contained in said acoustic signal on the basis of the extracted envelopes representing respective levels of said spectra:

means coupled to said detecting means for generating at least one musical sound signal each having a predetermined timbre and a frequency respectively corresponding to the at least one note detected by said detecting means, and including a predetermined number of musical sound generating channels to which the at least one note detected sequentially by said detecting means are allocated to generate a corresponding musical sound signal; and control means for allocating a note to an empty one of the predetermined number of musical sound generating channels to generate the corresponding musical sound signal when that note is different from those allocated already to the predetermined number of musical sound generating channels and is detected by said detecting means, and for instructing the musical sound generating channel to stop further generation of the musical sound signal corresponding to that note when the note allocated to the musical sound generating channel becomes not detected by said detecting means.

2. A musical instrument according to claim 1, wherein said digital signal processing means includes means for executing said digital bandpass filtering by performing a high-pass filtering operation with a predetermined characteristic, and sequentially performing low-pass filtering operations with a resonance having a peak at a frequency corresponding to each note on a time divisional basis.

3. A musical instrument, comprising:

means for receiving an acoustic signal to output a digital waveform signal representing said acoustic signal;

storing means for sequentially storing the digital waveform signal output from said receiving means;

digital signal processing means for sequentially performing (i) digital bandpass filtering operations on said digital waveform signal stored in said storing means carried out on a time divisional basis with frequencies corresponding to respective notes, and (ii) extracting operations to extract envelopes of waveform signals resulting from the bandpass filtering operations to detect respective levels of spectra of frequencies corresponding to said notes;

detecting means coupled to said digital signal processing means for detecting at least one note contained in said acoustic signal on the basis of the extracted envelopes representing respective levels of said spectra:

means coupled to said detecting means for generating at least one musical sound signal each having a predetermined timbre and a frequency respectively corresponding to the at least one note detected by said detecting means, and including a predetermined number of musical sound generating channels to which the at least one note detected sequentially by said detecting means are allocated to generate a corresponding musical sound signal; and control means for allocating a note to an empty one of the predetermined number of musical sound generating channels to generate the corresponding musical sound signal when that note is different from those allocated already to the predetermined number of musical sound generating channels and is detected by said detecting means, and for instructing the musical sound generating channel to stop further generation of the musical sound signal corresponding to that note when the note allocated to the musical sound generating channel becomes not detected by said detecting means.

4. A musical instrument according to claim 3, wherein said digital signal processing means includes means for executing said digital bandpass filtering by performing a high-pass filtering operation with a predetermined characteristic, and sequentially performing low-pass filtering operations with a resonance having a peak at a frequency corresponding to each note on a time divisional basis.

5. An apparatus, comprising:

means for receiving an acoustic signal to output a digital waveform signal representing said acoustic signal;

detecting means coupled to said receiving means for detecting respective notes contained in said digital waveform signal and respective levels of the notes thus detected;

means coupled to said detecting means for generating at least one musical sound signal each having a predetermined timbre and a frequency corresponding to the at least one note detected by said detecting means, and including a predetermined number of musical sound generating channels to which the at least one note detected sequentially by said detecting means are allocated to generate a corresponding control means for allocating a note to an empty one of the predetermined number of musical sound generating channels to generate the corresponding musical sound signal when that note is different from those allocated already to the predetermined number of musical sound generating channels and is detected by said detecting means, and for instructing the musical sound generating channels to stop further generation of the musical sound signal corresponding to that note when the note allocated to the musical sound generating channel becomes not detected by said detecting means.

6. An apparatus, comprising:

means for receiving an acoustic signal to output a digital waveform signal representing said acoustic signal;

storing means for sequentially storing the waveform signal output from said receiving means;

detecting means coupled to said storing means for detecting respective notes contained in said digital waveform signal stored in said storing means and respective levels of the notes thus detected;

means coupled to said detecting means for generating at least one musical sound signal each having a predetermined timbre and a frequency corresponding to the at least one note detected by said detecting means, and including a predetermined number of musical sound generating channels to which the at least one note detected sequentially by said detecting means are allocated to generate a corresponding musical sound signal; and control means for allocating a note to an empty one of the predetermined number of musical sound generating channels to generate the corresponding musical sound signal when that note is different from those allocated already to the predetermined number of musical sound generating channels and is detected by said detecting means, and for instructing the musical sound generating channel to stop further generation of the musical sound signal corresponding to that note when the note allocated to the musical sound generating channel becomes not detected by said detecting means.

* * * * *